US005575171A

United States Patent [19]

Sawai et al.

[11] Patent Number: 5,575,171

[45] Date of Patent: Nov. 19, 1996

[54] PROCESS AND APPARATUS FOR THE PRODUCTION OF WEBBING TAKE-UP SPINDLE

[75] Inventors: Hiroyuki Sawai; Yasuhisa Fujiwara, both of Kanagawa; Shoji Tabei, Gunma, all of Japan

[73] Assignee: NSK Ltd., Tokyo, Japan

[21] Appl. No.: 325,653

[22] Filed: Oct. 18, 1994

[30] Foreign Application Priority Data

Oct. 22, 1993 [JP] Japan ..... 5-286153

[51] Int. Cl.[6] ..... B21D 22/00; B21D 28/00

[52] U.S. Cl. ..... 72/352; 72/356; 72/335; 72/340

[58] Field of Search ..... 72/352, 335, 340, 72/356, 360; 29/893.34, 893.35

[56] References Cited

U.S. PATENT DOCUMENTS

| | | | |
|---|---|---|---|
| 1,336,493 | 4/1920 | Tibbetts | 29/893.34 |
| 1,360,358 | 11/1920 | Beall | 29/893.34 |
| 2,991,552 | 7/1961 | Chatfield | 72/340 |
| 3,258,834 | 7/1966 | Rork | 29/893.34 |
| 4,027,376 | 6/1977 | Brinkman | 29/893.35 |

FOREIGN PATENT DOCUMENTS

| | | |
|---|---|---|
| 59-73949 | 5/1984 | Japan . |
| 59-156534 | 9/1984 | Japan . |
| 5-13739 | 2/1993 | Japan . |

*Primary Examiner*—Lowell A. Larson
*Assistant Examiner*—Rodney Butler
*Attorney, Agent, or Firm*—Evenson, McKeown, Edwards & Lenahan, P.L.L.C.

[57] ABSTRACT

A process is provided for the production of a webbing take-up spindle by cold-forming of a cylindrical blank. The cylindrical blank is cold-formed into a preform having a flange-shaped disc portion and a spindle portion extending from and in continuation with said disc portion. Wedge action dies, whose pressing portions are in the form of ratchet teeth, are pressed against an upper and lower sides of an outer peripheral portion of the disc portion, respectively, so that ratchet teeth are partially formed and a thin-walled portion is also formed circumferentially along said partially-formed ratchet teeth. The thin-walled portion is then punched to fully form the ratchet teeth. A forming apparatus suitable for use in the practice of the process is also disclosed.

8 Claims, 7 Drawing Sheets

PROCESS AND APPARATUS FOR THE PRODUCTION OF WEBBING TAKE-UP SPINDLE

BACKGROUND OF THE INVENTION a) Field of the Invention

This invention relates to a process and apparatus for the production of a webbing take-up spindle suitable for use in a webbing retractor of a seat belt system. The webbing take-up spindle includes, as integrally formed elements, a spindle portion for taking up a webbing and ratchet teeth for stopping the spindle portion when the retractor has been locked.

b) Description of the Related Art

A webbing take-up spindle comprises a spindle portion and ratchet teeth as described above. As a very large force is applied in the event of a collision, the webbing take-up spindle is required to have high strength. Therefore it is usually produced by cold forming.

Several processes are known as production processes making use of cold forming. The cold forming process, which is disclosed as one of such known processes in Japanese Patent Publication (Kokoku) No. HEI 5-13739 published Feb. 23, 1993, comprises the following steps as shown in FIGS. 5A to 5F.

First, a cylindrical first blank 31*a* shown in FIG. 5A is provided. This cylindrical first blank 31*a* has a volume needed to form a take-up spindle.

(1) First step: The first blank 31*a* is subjected to end face setting or sizing in a die so that a shallow conical recess is formed in one end and a conical taper is formed on an opposite end. As a result, a Second blank 31*b* shown in FIG. 5B is obtained.

By using, as the above die, one capable of 10 forming a projection of a rectangular contour in cross-section (hereinafter simply referred to as a rectangular projection) on the opposite side of the blank upon conducting the above end face setting or sizing, it is possible to provide the second blank 31*b* with a rectangular projection 32 on the opposite end and a tapered conical surface 33 formed on a basal portion of the rectangular projection 32. This makes it possible to easily perform extrusion forming in a second step.

(2) Second step: The second blank 31*b*, which has been subjected to the end face setting or sizing, is inserted in a die and a spindle portion having a rectangular cross-section is then extrusion-formed by a punch. This extrusion forming provides a first preform 31*c* in which, as depicted in FIG. 5C, a cylindrical head portion 34 and a spindle portion 35 of a rectangular cross-section are connected together at the tapered surface 33.

(3) Third step: The first preform 31*c* is punched. By this punching, the head portion 34 of the first preform 31*c* is gradually tapered in an upward direction as viewed in FIG. 5D, whereby the top portion 34 is formed into a frustum of a right circular cone to obtain a second preform 31*d*.

(4) Fourth step: The head portion 34 of the second preform 31*d* is punched. As shown in FIG. 5E, a flange-shaped disc portion 36 and a projection 37 centrally defining a slot or a square recess therein are formed by this punching so that a third preform 31*e* is formed. At the same time, a tapered wall 33 (see FIG. 5B) is also formed on a stepped portion 41. The third preform 31*e* has the shape that the spindle portion 35 of the rectangular cross-section and the flange-shaped disc portion 36 extend in continuation with each other.

(5) Fifth step: Teeth 38 of a ratchet gear are punched in an outer peripheral portion of the flange-shaped disc portion 36 of the third preform 31*e*, whereby a formed product 40 shown in FIG. 5F is obtained as intended.

Such a conventional production process of a webbing take-up spindle, said process making use of cold forming, is however accompanied by problems as will be described next.

In the fifth step of the production process described above, the ratchet teeth are punched in the outer peripheral portion of the flange-shaped disc portion 36 of the third preform 31*e*. As a result, secondary fracture surfaces or fractures 39 maybe formed in tooth walls of the teeth 38 as shown in FIG. 6, leading to potential problems such that the tooth walls could have poor properties and the service life of a punching die could be shortened

SUMMARY OF THE INVENTION

With the foregoing problems in view, an object of the present invention is to provide a cold forming process suited for the formation of a webbing take-up spindle. Another object of the present invention is to provide a forming apparatus suitable for use in the practice of the above process.

Described specifically, an object of the present invention is to eliminate the above-described drawbacks in the production process of a webbing take-up spindle by cold forming, that is, to prevent occurrence of secondary fracture surfaces or fractures in the tooth walls upon punching the ratchet teeth in the outer peripheral portion of the flange-shaped disc portion of the preform.

Another specific object of the present invention is to obtain a webbing take-up spindle having ratchet teeth of good properties and assuring a long service life for a punching die by punching the ratchet teeth in the outer peripheral portion of the flange-shaped disc portion in accordance with the production process of a webbing take-up spindle by cold forming.

A further specific object of the present invention is to provide a forming apparatus suitable for use in the practice of such production processes.

In one aspect of the present invention, there is thus provided a process for producing a webbing take-up spindle by cold-forming a cylindrical blank, which comprises cold-forming said cylindrical blank into a preform having a flange-shaped disc portion and a spindle portion extending from and in continuation with said disc portion;

pressing wedge action dies, whose pressing portions are in the form of ratchet teeth, against an upper and lower sides of an outer peripheral portion of said disc portion, respectively, so that ratchet teeth are partially formed and a thin-walled portion is also formed circumferentially along said partially-formed ratchet teeth; and punching said thin-walled portion to fully form said ratchet teeth.

In another aspect of the present invention, there is also provided a forming apparatus for partially forming ratchet teeth on an outer peripheral portion of a flange-shaped disc portion of a preform, which has said flange-shaped disc portion and a spindle portion extending from and in continuation with said disc portion, by pressing dies whose pressing portions are in the form of ratchet teeth against an upper and lower sides of an outer peripheral portion of said disc portion, respectively, so that ratchet teeth are partially formed, wherein said pressing portions which are in the form of the ratchet teeth and are adapted to press said disc portion are each in the form of a wedge in a cross-section as viewed in a pressing direction.

To achieve the above-described objects, a primary technical feature of the present invention resides in that prior to punching the outer peripheral portion of the flange-shaped disc portion of the preform into teeth, the outer peripheral portion is partially formed into teeth by the dies to reduce the thickness of a portion to be punched. Punching is then effected, so that good ratchet teeth can be formed while improving the drawbacks which would otherwise occur by the punching of the teeth.

When the ratchet teeth are formed on the outer peripheral portion of the flange-shaped disc portion by pressing the outer peripheral portion by the wedge action dies, the thin-walled portion formed by the pressing around the resulting teeth preferably has a thickness ⅓ to ⅕ of the thickness of the disc portion. The portion surrounding the ratchet teeth is once made thinner by the above pressing instead of being punched at once and, in the next step, the resulting thin-walled portion around the ratchet teeth is punched to profile the outer peripheral portion into the ratchet teeth. No fractures are therefore formed in the ratchet teeth.

A webbing take-up spindle is required to have high strength since a very large force is applied to it in the event of a collision as described above. A high-strength metal, for example, boron steel is therefore used as a material for the webbing take-up spindle. Such a material, however, tends to develop fractures when ratchet teeth are formed in the above-described conventional manner. The present invention has made it possible to avoid such fractures even when a webbing take-up spindle is produced by cold forming from such a material because the portion surrounding the ratchet teeth is not punched into teeth at once but the portion around the ratchet teeth is once made thinner by pressing and the resulting thin-walled portion around the ratchet teeth is punched into teeth in the next step. The present invention therefore permits highly-efficient production of webbing take-up spindles with ratchet teeth having no fracture in their walls and having a good profile.

DETAILED DESCRIPTION OF THE INVENTION AND PREFERRED EMBODIMENT

Referring to FIGS. 1A through 4, the production process according to the one embodiment of the first aspect of the present invention and the forming apparatus according to the one embodiment of the second aspect of the present invention will be described hereinafter. It should however be borne in mind that the present invention is not limited to or by the following example.

Example 1

Figure 1A:
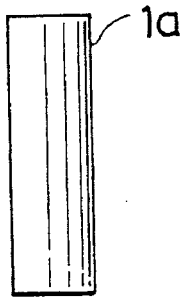
FIGS. 1A through 1F illustrate various steps of a production process as one example of the first aspect of the present invention.
Figure 1B:
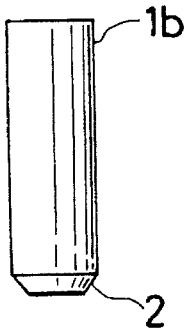

(1) First step: A cylindrical first blank 1*a* shown in FIG. 1A, which has a volume needed to form a webbing take-up. spindle, is punched so that the first blank 1*a* is subjected to end face setting or sizing to form a tapered portion 2 at one end thereof. As a result, a second blank 1*b* shown in FIG. 1*b* is obtained.

Figure 1C:
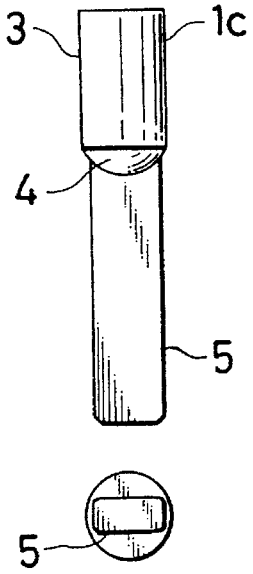

(2) Second step: The second blank 1*b* which has been subjected to the end face setting or sizing in the first step is placed in a die and a spindle portion 5 of a rectangular cross-section is extruded by a punch. This provides a first preform 1*c* of the shape that, as illustrated in FIG. 1C, a cylindrical head portion 3 and the spindle portion 5 of the rectangular cross-section are connected together at a conical tapered wall 4. In FIG. 1C, the upper drawing is a side view of the first preform 1*c* while the lower drawing is its bottom view.

Figure 1D:
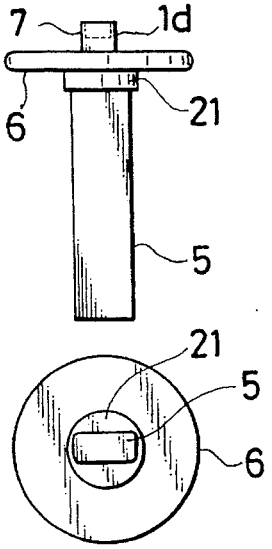

(3) Third step: The first preform 1*c* obtained in the second step is punched so that the head portion 3 of the first preform 1*c* is formed into a flange-shaped disc portion 6 and a projection 7 having a slot or square recess centrally formed therein. At the same time, the tapered wall 4 is also formed into a stepped portion 21. As is illustrated in FIG. 1D, a second preform 1*d* is obtained, in which the spindle portion 5 of the rectangular cross-section and the disc portion 6 are connected together. In FIG. 1D, the upper drawing is a side view of the second preform 1*d* whereas the lower drawing is its bottom view.

(4) Fourth step: The second preform 1*d* obtained in the third step is placed in a central bore 10 of a die 11 arranged in a forming apparatus 8 shown in FIG. 2. Another die 12 is disposed around the first-mentioned die 11. A wedge action die portion 12*a*, which is located at an upper edge part of an inner peripheral portion of the die 12, is in the form of teeth. The die 12 is arranged so that the wedge action die portion 12*a* can be brought into contact with a lower side of an outer peripheral portion of the disc portion 6 of the second preform 1*d*. In a lower part of the central bore 10 of the die 11, a knock-out pin 13 is inserted to support the second preform 1*d* thereon. Next, a punch 9 is arranged on an upper side of the disc portion 6 of the second preform 1*d*. This punch 9 centrally defines a bore. The projection 7 of the second preform 1*d* is inserted in the bore of the punch 9 and another knock-out pin 14 is arranged on the projection 7. Another wedge action die portion 9*a* is located at a lower edge part of an outer peripheral portion of the punch 9. This wedge action die portion 9*a* is also in the form of teeth. The punch 9 is arranged so that the wedge action die portion 9*a* can be brought into contact with the upper side of the outer peripheral portion of the disc portion 6 of the second preform 1*d*.

The wedge action die portions 9*a*,12*a* have a wedge-shaped cross-sectional profile when viewed in a pressing direction. Neither die portions 9*a*,12*a* are provided with such a cutting edge portion as that required for forming teeth by punching. They have a profile suited for the formation of a thin-walled portion by pressing. When ratchet teeth corresponding to the profiles of the wedge action die portions 9*a*,12*a* have been formed as a result of forming of the second preform 1*d* by the wedge action die portions 9*a*,12*a*, a thin-walled portion is formed circumferentially around the partially-formed ratchet teeth.

When the forming apparatus 8 is operated by a hydraulic system (not shown) to press the punch 9 and the dies 11,12, the outer peripheral portion of the disc portion 6 of the second preform 1*d* is pressed by the punch 9 and the die 12, so that a portion with which the punch 9 and the die 12 have been brought into contact is reduced in thickness. Because of the difference in thickness, steps are formed on both upper and lower sides of the outer peripheral portion of the disc portion 6. This means that the ratchet teeth have been formed in part.

Figure 1E:
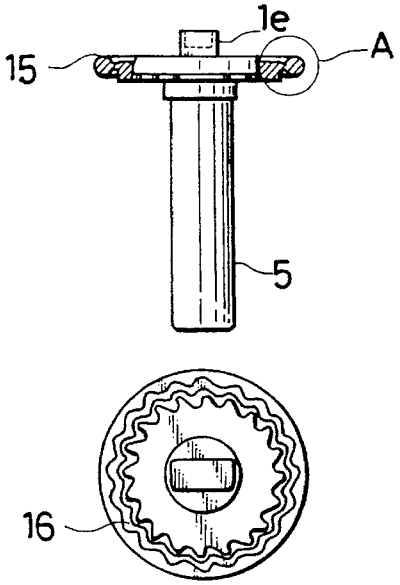

A third preform 1*e* formed by the above forming operation is illustrated in FIG. 1E. The upper view in FIG. 1E is a side view of the third preform 1*e*, in which the outer peripheral portion of the disc portion 6 is shown in a partial cross-section. The disc portion 6 has a thin-walled portion and an outer peripheral portion 15 located on an outer side of the thin-walled portion.

Figure 3:
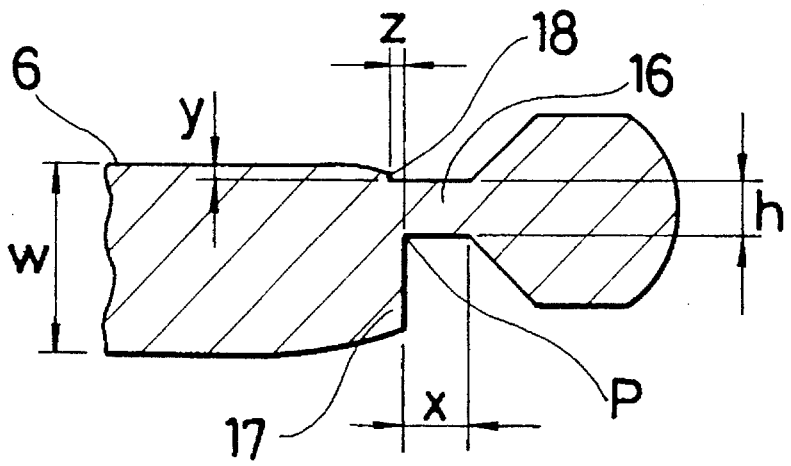
FIG. 3 is an enlarged cross-sectional view of a part indicated by letter A in FIG. 1E.
Figure 4:
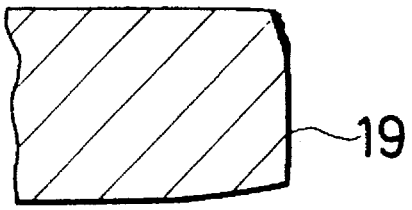
FIG. 4 is an enlarged cross-sectional view of a part indicated by letter B in FIG. 1F.
Figure 5A:
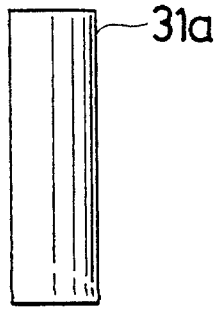
FIG. 5A PRIOR ART
FIGS. 5A through 5F illustrate various steps of a conventional production process of a webbing take-up spindle.
Figure 5B:
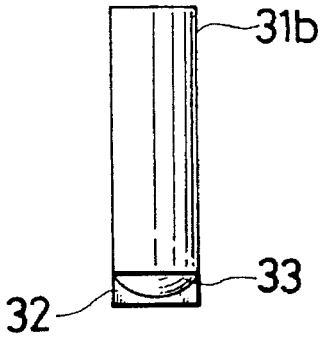
FIG. 5B PRIOR ART
Figure 5C:
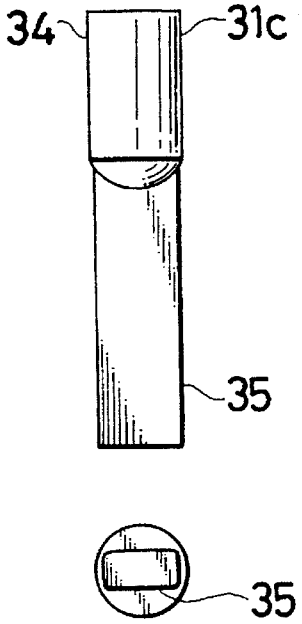
FIG. 5C PRIOR ART
Figure 5D:
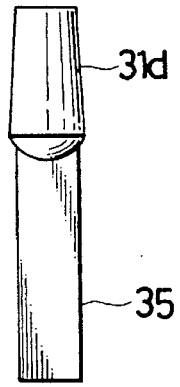
FIG. 5D PRIOR ART
Figure 5E:
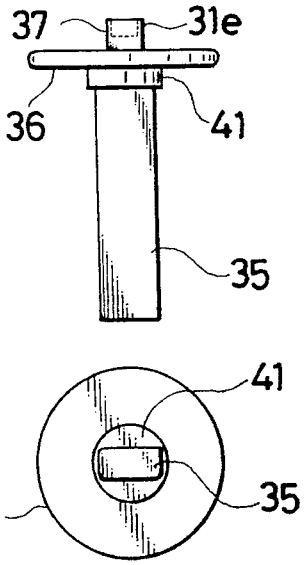
FIG. 5E PRIOR ART
Figure 5F:
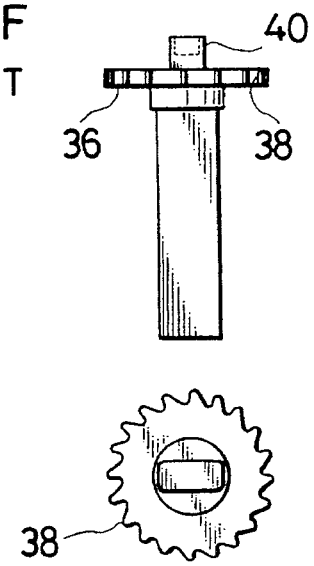
FIG. 5F PRIOR ART
Figure 6:
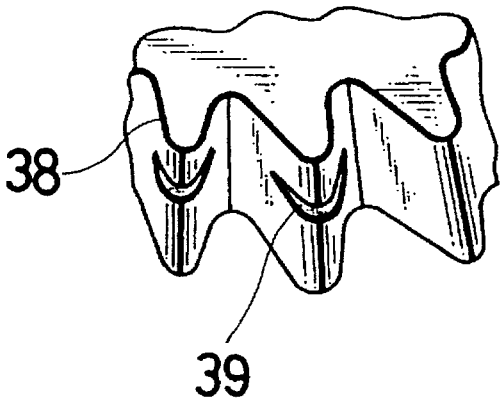
FIG. 6 PRIOR ART
FIG. 6 is an enlarged fragmentary perspective view of teeth of the webbing take-up spindle produced by the conventional production process.

A part of the outer peripheral portion of the disc portion 6 of the third preform 1*e*, which is the part A indicated by letter A in FIG. 1E, is shown on an enlarged scale in FIG. 3. The profiles of the wedge action die portion 9*a*,12*a* of the punch 9 and the die 12 as well as the pressing operation making use of the wedge action die portion 9a,12a should preferably be determined to permit the formation of a thin-walled portion of such a structure as shown in FIG. 3 so the punching of teeth in the next step can be facilitated.

Details of the outer peripheral portion will now be described based on FIG. 3. To separate the outer peripheral portion of the second preform 1*d*, said outer peripheral portion presenting ratchet teeth to be formed by the upper and lower wedge action die portions 9*a*,12*a* in the form of the ratchet teeth, from an excess metal portion located outside the outer peripheral portion, a portion 16 (thin-walled portion) where the outer peripheral portion and the excess metal portion are connected to each other is pressed to a thickness h.

Since this thin-walled portion 16 is a portion to be punched in the next step, its thickness h is reduced to about ¼ of a thickness W of the disc portion to facilitate its punching. The outer peripheral portion of the disc portion 6 has already been worked to a high degree, so that further working thereon for a reduction in thickness results in occurrence of fractures. The width (i.e., the dimension corresponding to x in FIG. 3) of each tooth on the wedge action die portions 9*a*,12*a* is set at 1–2 mm to allow excess metal to be relieved in the form of wedges. This has made it possible to suppress formation of fractures in the outer peripheral portion of the disc portion and further to prevent spreading of such fractures to ratchet teeth.

Further, the ratchet teeth are smaller by a distance z over the entire surface on the side where the spindle-portion 5 is not located than on the side where the spindle portion 5 is located. As to the direction of punching in the next step, the outer peripheral portion 15 is punched in a direction away from the spindle portion 5 of the rectangular cross-section. Therefore, the penetration (y) on the side where the spindle portion 5 is not located is limited to a shallow depth not greater than 0.5 mm, and a shoulder portion of each of said ratchet teeth on the side where said spindle portion is not located, said shoulder portion being located adjacent said thin-walled portion, is formed into a sharp edge 18. The distance z may preferably be set at 5 to 15% of h. Anyhow, it is important to choose the value of the distance z so that no defect such as fracture or burr will occur by the punching operation in the next step.

(5) Fifth step: The thin-walled portion 16 located outside the ratchet teeth formed in fourth step are punched. At this time, punching begins at a point P and rupture then takes place from an intermediate point toward the tooth-shaped edge 18 formed in the preceding step, whereby a ratchet tooth 19 free of a defect such as a fracture or burr is formed.

Figure 1F:
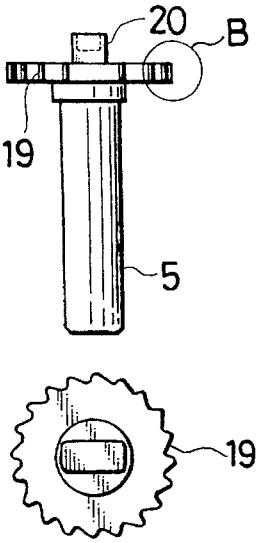
Figure 2:
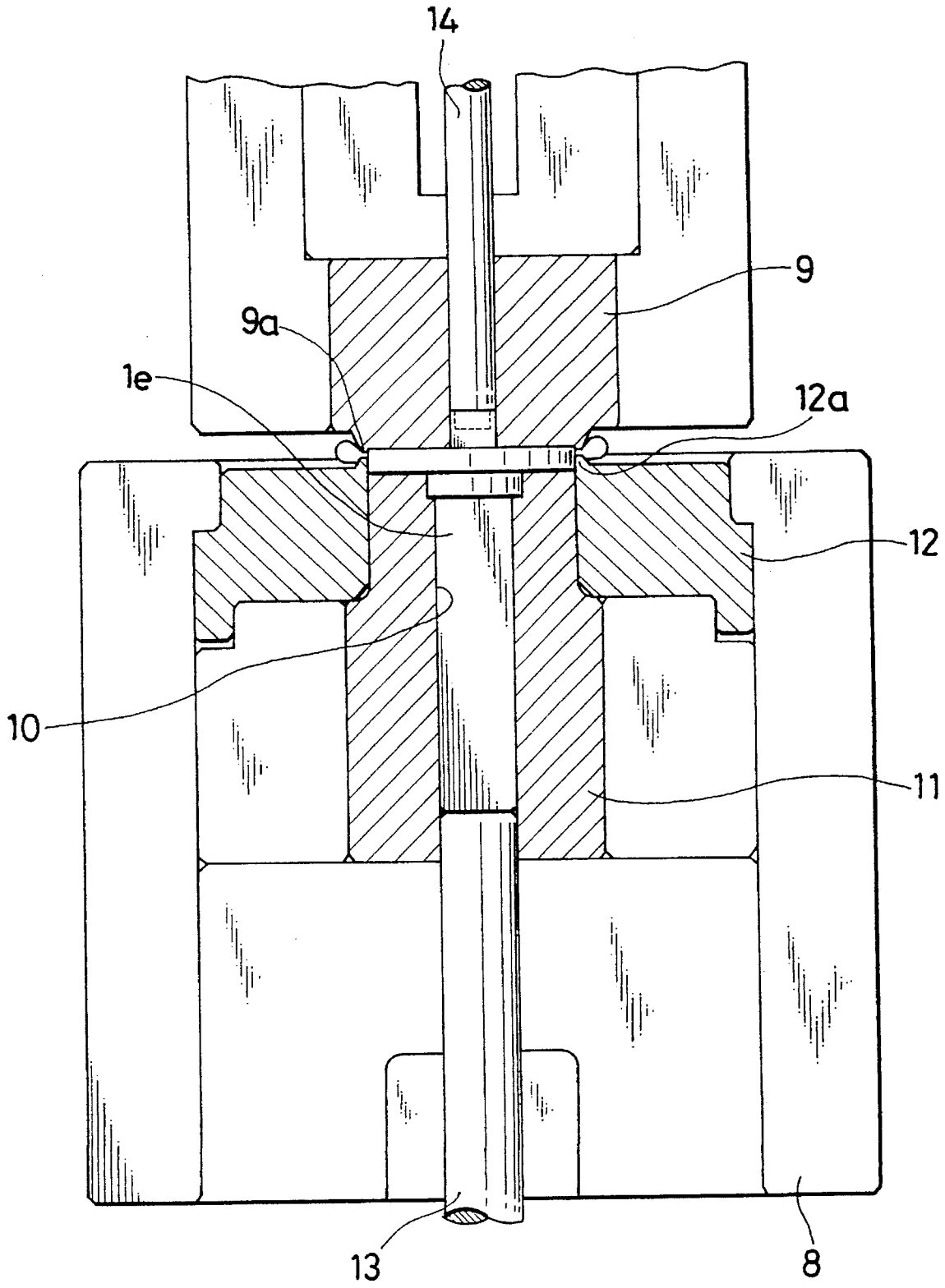
FIG. 2 is a fragmentary vertical cross-sectional view of a forming apparatus as one example of the second aspect of the present invention, in which the forming apparatus is used to perform a preforming step of ratchet teeth.

A product 20 obtained in the fifth step is shown in FIG. 1F. An end portion (the part B in FIG. 1F) of a ratchet tooth is shown in cross-section in FIG. 4. The formation of the sharp edge 18 illustrated in FIG. 3 facilitated the punching operation and moreover, provided a smooth cut surface.

What is claimed is:

1. A process for producing a webbing take-up spindle by cold-forming a cylindrical blank, comprising:

cold-forming said cylindrical blank into a preform having a flange-shaped disc portion and a spindle portion extending from and in continuation with said disc portion;

pressing wedge action dies, whose pressing portions are in the form of ratchet teeth, against upper and lower sides of an outer peripheral portion of said disc portion, respectively, so that ratchet teeth are partially formed and a thin-walled portion is also formed circumferentially along said partially-formed ratchet teeth at a position deviated toward said upper side of the flange-shaped disc portion; and punching said thin-walled portion from said lower side to fully form ratchet teeth.

2. A process according to claim 1, wherein said thin-walled portion has a thickness ⅓ to ⅕ of the thickness of said disc portion.

3. A process according to claim 1, wherein said thin-walled portion has a width of from 1 mm to 2 mm.

4. A process according to claim 1, wherein over the entire upper and lower sides, said partially-formed ratchet teeth are smaller on said upper side than on said lower side.

5. A process according to claim 1, wherein said upper side is a side where said spindle portion is not located and said lower side is a side where said spindle portion is located.

6. A process according to claim 4, wherein said partially-formed ratchet teeth are smaller by 5 to 15% of the thickness of the thin-walled portion on said upper side than on said lower side.

7. A process according to claim 4, wherein a penetration formed as a result of said pressing of said wedge action die on said upper side is not greater than 0.5 mm.

8. A process according to claim 4, wherein a shoulder portion of each of said ratchet teeth on said one side, said shoulder portion being located adjacent said thin-walled portion, is formed into a sharp edge.

* * * * *